US009835068B2

(12) United States Patent
Mueller

(10) Patent No.: US 9,835,068 B2
(45) Date of Patent: Dec. 5, 2017

(54) MIXER DEVICE

(75) Inventor: Michael Mueller, Nagold (DE)

(73) Assignee: FRIEDRICH BOYSEN GMBH & CO. KG, Altensteig (DE)

( * ) Notice: Subject to any disclaimer, the term of this patent is extended or adjusted under 35 U.S.C. 154(b) by 836 days.

(21) Appl. No.: 14/240,715

(22) PCT Filed: Aug. 17, 2012

(86) PCT No.: PCT/EP2012/066060

§ 371 (c)(1),
(2), (4) Date: Sep. 12, 2014

(87) PCT Pub. No.: WO2013/026782

PCT Pub. Date: Feb. 28, 2013

(65) Prior Publication Data

US 2015/0016214 A1 Jan. 15, 2015

(30) Foreign Application Priority Data

Aug. 24, 2011 (DE) ..... 10 2011 111 765

(51) Int. Cl.

| | |
|---|---|
| ***B01F 5/06*** | (2006.01) |
| ***F01N 3/20*** | (2006.01) |
| ***B01F 3/04*** | (2006.01) |

(52) U.S. Cl.

CPC ..... *F01N 3/206* (2013.01); *B01F 3/04007* (2013.01); *B01F 5/0606* (2013.01); *B01F 5/0616* (2013.01); *B01F 2005/0639* (2013.01)

(58) Field of Classification Search

CPC ..... B01F 5/0606

(Continued)

(56) References Cited

U.S. PATENT DOCUMENTS 692,444 A * 2/1902 Harris ..... F02M 3/10 123/593
1,038,262 A * 9/1912 Anstice ..... F02M 29/06 138/37

(Continued)

FOREIGN PATENT DOCUMENTS

CN 1198960 11/1998
CN 2598629 Y 1/2002

(Continued)

OTHER PUBLICATIONS

German Search Report dated Mar. 15, 2012.
English Translation of German Search Report dated Mar. 15, 2012.

*Primary Examiner* — David Sorkin
(74) *Attorney, Agent, or Firm* — Amster, Rothstein & Ebenstein LLP

(57) ABSTRACT

The present invention relates to a mixer device for distributing and evaporating a liquid introduced into a gas flow, in particular into an exhaust-gas flow, wherein the mixer device comprises at least one mixer vane (14*a*) which influences the flow direction of the gas flow. The mixer vane has a first vane (14*a*') portion and a second vane portion (14*a*") which are arranged in series in the flow direction of the gas flow, which vane portions are designed so that the first vane portion diverts the gas flow approaching the mixer device such that said gas flow has a first swirl component imparted thereto, and so that the second vane portion subsequently diverts the gas flow such that said gas flow has a second swirl component imparted thereto, wherein the first swirl component and the second swirl component oppose one another.

9 Claims, 5 Drawing Sheets

Figure 1:
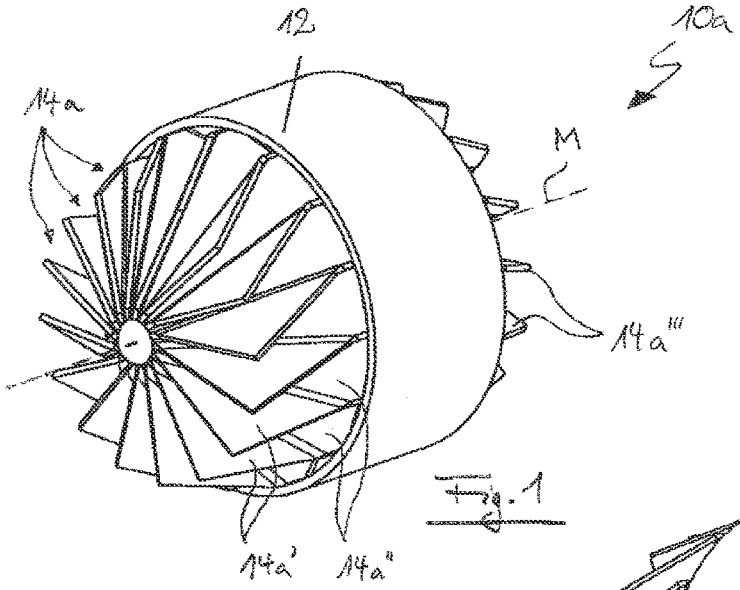

(58) Field of Classification Search
USPC ..... 366/181.5, 336–339; 48/189.4
See application file for complete search history.

(56) References Cited

U.S. PATENT DOCUMENTS

| | | | | | |
|---|---|---|---|---|---|
| 1,144,040 | A * | 6/1915 | Keller | F02M 1/00 | 138/41 |
| 1,156,975 | A * | 10/1915 | Clark | F02M 1/00 | 137/898 |
| 1,186,386 | A * | 6/1916 | Egan et al. | F02M 1/00 | 48/160 |
| 1,778,790 | A * | 10/1930 | Brandl et al. | F02M 1/00 | 138/37 |
| 1,921,282 | A * | 8/1933 | Cook | F02M 1/00 | 138/37 |
| 3,635,444 | A * | 1/1972 | Potter | B01F 5/0615 | 366/339 |
| 4,336,838 | A | 6/1982 | Ely | | |
| 6,536,420 | B1 * | 3/2003 | Cheng | B01F 5/0616 | 123/590 |
| 2008/0056064 | A1 * | 3/2008 | Tanaka | B01F 5/0451 | 366/339 |
| 2008/0089173 | A1 * | 4/2008 | Lu | A61O 5/064 | 366/339 |
| 2009/0235653 | A1 | 9/2009 | Mital et al. | | |
| 2009/0262599 | A1 * | 10/2009 | Kohrs | B01F 5/0643 | 366/337 |
| 2009/0266064 | A1 | 10/2009 | Zheng et al. | | |
| 2011/0174408 | A1 | 7/2011 | Lundberg et al. | | |
| 2013/0188444 | A1 * | 7/2013 | Palmer | B01F 5/0473 | 366/337 |

FOREIGN PATENT DOCUMENTS

| | | | |
|---|---|---|---|
| CN | 101539046 | | 9/2009 |
| CN | 102084103 | | 6/2011 |
| DE | 102006024199 | A1 | 11/2007 |
| DE | 102007012790 | A1 | 9/2008 |
| DE | 102007028449 | A1 | 10/2008 |
| DE | 102008029110 | A1 | 12/2009 |
| EP | 0655275 | A1 | 5/1995 |
| EP | 0864732 | A1 | 9/1998 |
| EP | 1514591 | A1 | 3/2005 |
| WO | 20090157995 | A1 | 12/2009 |
| WO | 2011010850 | A2 | 1/2011 |

* cited by examiner

MIXER DEVICE

The present invention relates to a mixer device for distributing and vaporizing a liquid introduced into a gas flow, in particular into an exhaust gas flow.

The problem of vaporizing and distributing a liquid reliably in a suitable form in a gas flow in order, for example, to allow a chemical reaction of components of the gas flow with components of the vaporized liquid is one which arises in a number of application areas. This problem arises in exhaust gas engineering, for example, in connection with the SCR process in which an aqueous urea solution is introduced into the exhaust train of a motor vehicle, for example by means of a metering pump or an injector. Ammonia and $CO_2$ are produced from the urea solution by thermolysis and hydrolysis. The ammonia produced in this manner can react in a suitable catalytic converter with the nitrogen oxides contained in the exhaust gas which are thus efficiently removed from the exhaust gas.

It is of particular relevance in this process that the urea solution is supplied in a suitable ratio to the nitrogen oxide quantity contained in the exhaust gas. It is moreover of great importance that the urea solution introduced into the exhaust gas flow vaporizes as completely as possible and is uniformly distributed in the exhaust gas flow.

To ensure an efficient distribution and vaporization of the liquid introduced into the gas flow, a mixer device is frequently provided after the introduction point of the liquid in the flow direction. Although conventional mixer devices effect an acceptable degree of homogenization of the gas flow in many cases, there is still a need for more efficient mixer devices to achieve a distribution of the liquid in the gas flow which is as complete as possible and is in particular fast.

Efficient mixer devices are in particular in demand in exhaust gas engineering. The greater the efficiency of the mixer device namely is, the better the quantity of urea injected into the exhaust gas flow can be adapted to the quantity of nitrogen oxides contained in the exhaust gas. This ultimately results in an improved emission control.

It is therefore an object of the present invention to provide a more efficient mixer device for distributing and vaporizing a liquid introduced into a gas flow.

This object is satisfied by a mixer device having the features of claim 1.

In accordance with the invention, the mixer device comprises at least one mixer blade which influences the flow direction of the gas flow and which has a first blade section and a second blade section. The blade sections are arranged behind one another in the flow direction of the gas flow. They are furthermore designed so that the first blade section deflects the gas flow flowing onto the mixer device such that the gas flow receives a first swirl component and such that the second blade section subsequently deflects the gas flow such that it receives a second swirl component. The first swirl component and the second swirl component are opposite one another.

In other words, the first blade section effects a flow deflection which imparts a swirl to the gas flow. I.e. the gas flow which, for example, flows onto the mixer device in a substantially axial direction receives a flow component by the first blade section in the peripheral direction or in the tangential direction with respect to a central axis of the mixer device The gas flow deflected by the first blade section is again deflected by the second blade section, with the gas flow receiving a second swirl component which is opposite to the first swirl component. The second swirl component is likewise a flow direction component of the gas flow in the peripheral direction or in the tangential direction. It faces in the opposite direction, i.e. the first and second swirl components have opposite senses so that an at least partial reversal of the swirl of the gas flow which was caused by the first blade section is achieved by the second blade section.

An improved mixing of the fast flow is achieved, on the one hand, by the above-described configuration of the mixer device. On the other hand, it is effected by the swirl direction components forced onto the gas flow that the probability of collisions of the droplets of the liquid in the gas flow with one of the blade sections is increased. I.e. a certain portion of the droplets contained in the gas flow impacts the mixer blade due to the first flow deflection. They partly vaporize there due to the high temperature of the mixer blades. A further portion of the droplets bursts due to the impact on the mixer blade, whereby finer secondary droplets are therefore produced which are easier to vaporize.

The flow direction change of the gas flow produced with the aid of the second blade section effects a swirl reversal. It is accompanied by a repeat possibility of a droplet-mixer blade integration. I.e. the droplets which originally entered into the mixer device and which have not yet vaporized due to the first gas flow deflection and the secondary droplets are again exposed to the above-described effects, whereby the efficiency of the mixer device is increased. Despite an improved mixing effect and vaporization effect of the mixer device in accordance with the invention due to the swirl direction reversal of the gas flow and a multiple droplet-mixer interaction thereby brought about, the counter-pressure produced by the mixer device only increases comparatively little. The greater efficiency of the mixer device in accordance with the invention allows it to be able to have a shorter construction than conventional mixer devices with comparable degrees of homogenization.

Provision can admittedly be made that the first swirl component and the second swirl component are substantially of equal size; however, it is preferred if a swirl of different degrees is produced by the first and second blade sections.

The first blade section and/or the second blade section can be inclined or curved with respect to a center axis of the mixer device. The first blade section and/or the second blade section in particular have different angles of inclination or curvatures with respect to the center axis. The fact can thereby be taken into account, for example, that the first blade section and the second blade section are exposed to different conditions. A certain mixing and liquid vaporization is, for example, already produced by the first blade section so that the gas flow deflected by it has different properties than the gas flow upstream of the first blade section.

An embodiment of the mixer device is simple from a technical construction aspect, but nevertheless effective, in which the first blade section and/or the second blade section each form a plane.

In accordance with an embodiment, an angle of inclination of the first blade section amounts to no more than 25° at at least its upstream end with respect to the center axis. In other words, the first blade section is set by up to 25° relative to an undisturbed main flow direction of the gas flow at least in an inlet-side region, which means nothing other than an inlet-side edge or am upstream edge of the first blade section is inclined by 25° or less relative to the main flow direction. The angle of inclination is thus the angle which a particle of the gas flow "sees" when it enters into the mixer device in the region of the inlet-side edge. Ultimately, the angle of inclination is therefore the inclination of the first blade section in a tangential plane of the mixer blade relative to the center axis of the mixer device. The restriction of the inlet-side angle of inclination to 25° or less minimizes the occurrence of separations of flow in the region of the inlet-side edge.

Provision can alternatively or additionally be made that an angle of inclination of the second blade section does not amount to more than 35° with respect to the center axis at least at its downstream end. Analogously to the angle of inclination described above in connection with the first blade section, the angle of inclination in this embodiment is the angle between a tangent at a surface of an outlet-side edge of the second blade section in a tangential plane of the mixer blade relative to a main flow direction of the gas flow or to the center axis of the mixer device. The advantage of choosing an angle of inclination of 35° or less is that the counter-pressure produced by the mixer device is comparatively small.

With a planar configuration of the blade sections, this means that a comparatively large angle is present between a surface normal of the blade sections and the center axis. The same applies analogously to curved blade sections. A small angle setting of the blade sections relative to the flow axis of the gas flow contributes to avoiding separations of flow and dead water zones resulting therefrom which accompany a disadvantageous counter-pressure increase.

The first blade section and/or the second blade section can comprise at least two segments which have different angles of inclination or curvatures with respect to the center axis and which are in particular arranged at the downstream end of the corresponding blade section. A greater scattering of the outlet angles of the droplets rebounding at the respective blade section or at the segments as well as a greater turbulence of the gas flow are thereby achieved. This effect is particularly striking when the second blade section is provided with such segments in order also to achieve a better homogenization of the gas flow in the wake of the mixer device.

An additional increase in efficiency is achieved when a third blade section is arranged in the axial direction between the first blade section and the second blade section and is in particular configured as a plane. The third blade section can extend in substantially the axial direction of the mixer device. It provides a further possibility for droplet-mixer blade interaction and gives the swirl reverse of the gas flow a more gentle aspect.

A transition region between the first blade section and the second blade section and/or between the first blade section and the third blade section and/or between the third blade section and the second blade section can be a straight edge inclined with respect to a center axis of the mixer device. Such a mixer blade can be formed in a simple manner by a shaping process, in particular a bending process, from a planar sheet metal part. The edge is in this case, for example, a bending edge which separates two mutually inclined blade sections.

A further solution of the initially named problem in particular deals with a more efficient vaporization of the liquid introduced into the gas flow.

This aspect of the invention looks at the problem that surface impact densities above the film boiling limit are frequently reached on the mixer blades on the use of metering modules for introducing the liquid into the gas flow which have a point radiation characteristic. In other words, so many droplets impact specific regions of the mixer blades that boiling processes of separate individual droplets no longer occur there, but rather that a throughgoing vapor film is produced on the surfaces of the mixer blades which has a thermally insulating effect. This ultimately has the result that the heat transfer from the mixer device to the liquid-gas mixture is reduced and thus less liquid can be changed into the gas phase.

This effect can be counter-acted by a reduction of the surface impact density, for example in that the mixer blades are provided with an effective vaporizer surface which is as large as possible. However, this measure is subject to geometrical limits, for instance due to the limited construction space available to the mixer device. A further possibility for avoiding film boiling is the increase of the number of mixer blades. However, the counter-pressure produced by the mixer device thereby increases, which is likewise disadvantageous.

The aspect of the invention described in the following is based on the recognition that instead of the measures described above, influence can be taken on the temperature distribution at the surface of the mixer blades to effect a more efficient vaporization. It was recognized in this respect that the parameter "thermal conductivity" of the mixer blades is of decisive importance. In other words, in accordance with the invention, the thermal conductivity of the mixer blades is deliberately modified to achieve a temperature distribution assisting the efficient vaporization of the liquid.

For this purpose, the mixer device comprises at least one mixer blade influencing the flow direction of the gas flow which has at least one means for the local influencing of the thermal conductivity for setting a predefined temperature distribution at the surface of the mixer blade.

It should in particular be prevented by the named means that the blade temperature in the single-droplet vaporization region falls below the thermolysis temperature. In contrast to this, in the regions in which a liquid film is formed, a temperature of 100° C. should not be exceeded in order reliably to suppress a slow thermolysis and the deposition of intermediate products on the surface of the mixer blade associated with this.

This means comprises at least one slit, for example. The thermal conductivity in blade regions in which high impact densities and ultimately an exceeding of the film boiling limit arise is reduced to a suitable degree by a suitable position and configuration of the slit. It must be taken into account in the spatial arrangement and configuration of the at least one slit that the thermal conductivity in other blade regions still has to be large enough that the single-droplet vaporization is still ensured.

Additionally or alternatively, the named means can comprise at least one hole. Such a hole likewise effects a local change of the thermal conductivity. The mixer blade in particular has a plurality of small holes or perforations. The choice of a suitable hole distribution pattern makes it possible in a simple manner to achieve a directed local influencing of the mixer blade so that the desired temperature distribution at the surface of the mixer blade is set in operation of the mixer device.

Further measures which can be provided alone or in a complementary manner to the local influencing of the thermal conductivity are, for example, at least a local variation of the thickness of the material of the mixer blade—which is produced, for instance, by a suitable insert—and/or at least a local variation of the surface property of the mixer blade.

It is understood that the above-named measures for the local influencing of the thermal conductivity of the mixer blade can be combined as desired to obtain the desired result. It must generally be taken into account in this respect that the effectivity of the measures is also determined by the selection of the base material of the mixer blade. Not only steels of suitable quality and composition can be used as the base material, but also ceramic materials or so-called "porous stainless steel sheet".

In accordance with an embodiment, the slit can extend substantially in the flow direction of the gas flow. Alternatively or additionally, the slit can be open in the upstream direction or in the downstream direction.

It proves to be advantageous in certain cases if a plurality of slits are provided to produce a suitable temperature distribution at the surface of the mixer blade. The slits are in particular alternatingly open in the upstream direction or in the downstream direction.

The mixer blade of the above-described mixer devices can generally extend from the center axis in a substantially radial direction to a housing which is in particular configured in ring shape. Furthermore, a plurality of mixer blades can be provided which are distributed in the peripheral direction of the mixer device, and are in particular arranged uniformly distributed.

A further aspect of the present invention relates to a mixer device of the initially named kind, wherein the mixer device has a plurality of mixer blades which influence the flow direction of the gas flow and which extend in each case from a center axis of the mixer device in the substantially radial direction to a housing in particular configured in ring shape.

The mixer blades are, for example, fastened to the housing by a soldering process with such mixer devices. For technical production reasons, the mixer blades are, however, usually first connected to one another by a suitable connection process in the region of the center axis of the mixer device. Subsequently, the mutually connected mixer blades are inserted together into the housing and are connected to the housing. On temperature fluctuations accompanying the manufacturing process, the different connections, the mixer blades and also the housing are exposed to high thermomechanical stresses since the involved components are substantially rigidly connected to one another. Such stresses also occur on temperature changes in operation of the mixer device. Damage to the different connections can be a consequence of the stresses, in particular in the region of the housing, and this damage can in the worst case result in a separation of individual mixer blades.

It is therefore a further object of the present invention to provide a mixer device which is more robust than conventional mixer devices without their efficiency suffering from the more robust configuration.

This object is satisfied in accordance with the invention in that the mixer blades are only connected to one another in the region of the center axis by a point-like, localized auxiliary assembly connection. The term "point-like" is in this respect not to be understood only as a point-shaped connection. The connection can, for example, also be of ring shape, oval or elongate. What is important, however, is that the connection is limited in a spatially tight manner. It is thereby possible that the mixer blades can admittedly be connected to one another for simplified assembly, on the one hand. On the other hand, the point-like, localized auxiliary assembly connection, however, allows relative movements to a certain degree of the sections of the mixer blades not connected to one another. This is not the case with the conventionally provided large-area connections which as a rule comprise comparatively extensive contact regions of adjacent mixer blades.

In accordance with an embodiment, the auxiliary assembly connection comprises a weld point, in particular only one weld point.

The auxiliary assembly connection is in particular only provided at an upstream side or at a downstream side of the mixer blades. The respective other side of the mixer blades is thereby provided with the possibility of performing compensation movements.

For the at least part decoupling of the auxiliary assembly connection from the housing connection of the mixer blades, the latter can respectively have at least one join which is in the manner of a slit and which extends substantially in the flow direction of the gas flow. In other words, the join serves for the compensation of thermal stresses which can arise on the assembly or on the operation of the mixer device.

The joint is in particular open upstream or downstream. The join is preferably open at the side at which the auxiliary assembly connection is provided. A plurality of joins can also be provided which are in particular alternatingly open in the upstream direction or in the downstream direction.

In accordance with an embodiment, the join is arranged closer to the center axis of the mixer device than to the housing, in particular in spatial proximity to the auxiliary assembly connection. The join can have a longitudinal extent which amounts to less than half the extent of the mixer blades in the gas flow direction.

It is understood that the different aspects of the invention—in simplified terms the aspects of "swirl reversal", "influencing of the thermal conductivity in the region of the mixer blades by at least one slit" and "provision of an auxiliary assembly connection for reducing thermomechanical stresses"—and the features of the further developments associated therewith can be included in a mixer device independently of one another or in any desired combination to provide a mixer device suitable for the respective application.

Further embodiments of the different aspects of the invention are set forth in the description, in the claims and in the enclosed drawings.

Figure 2:
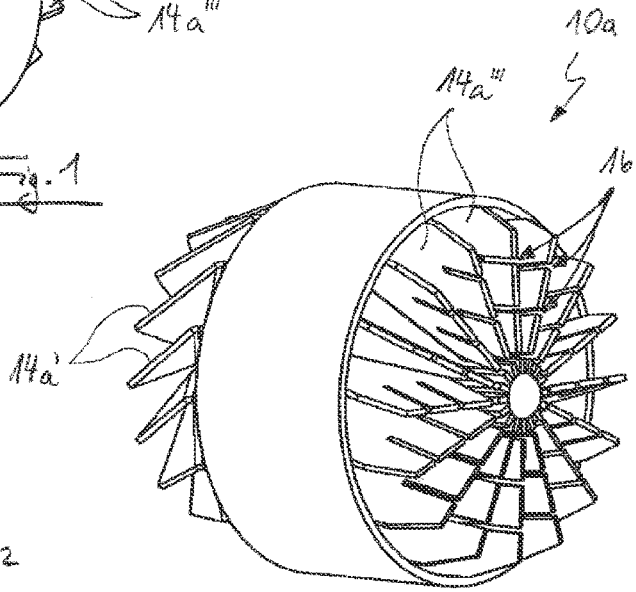
Figure 3:
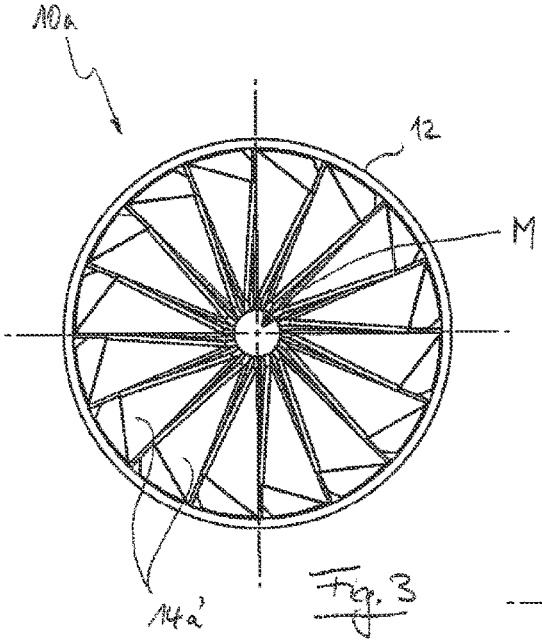
Figure 4:
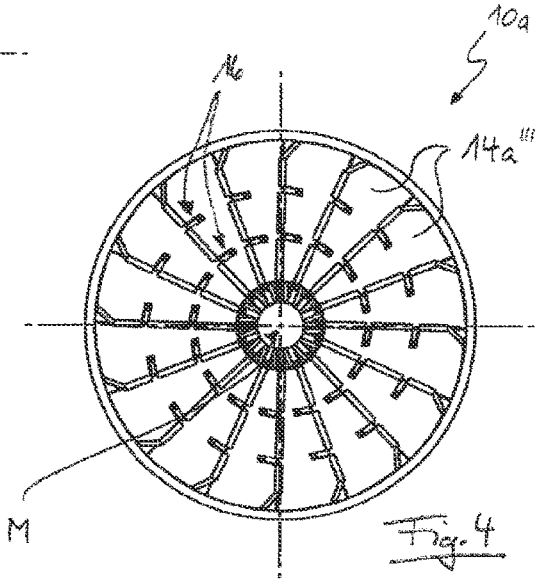
Figure 5:
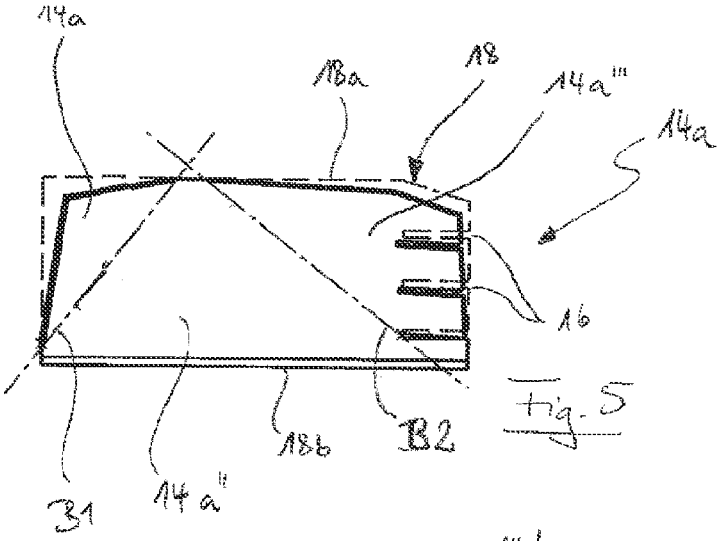
Figure 6:
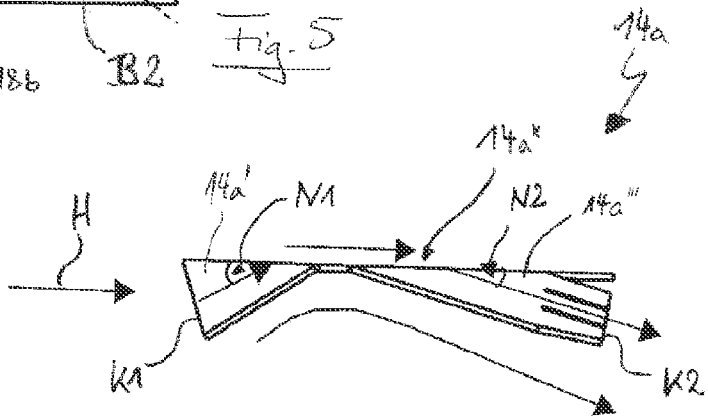
Figure 7:
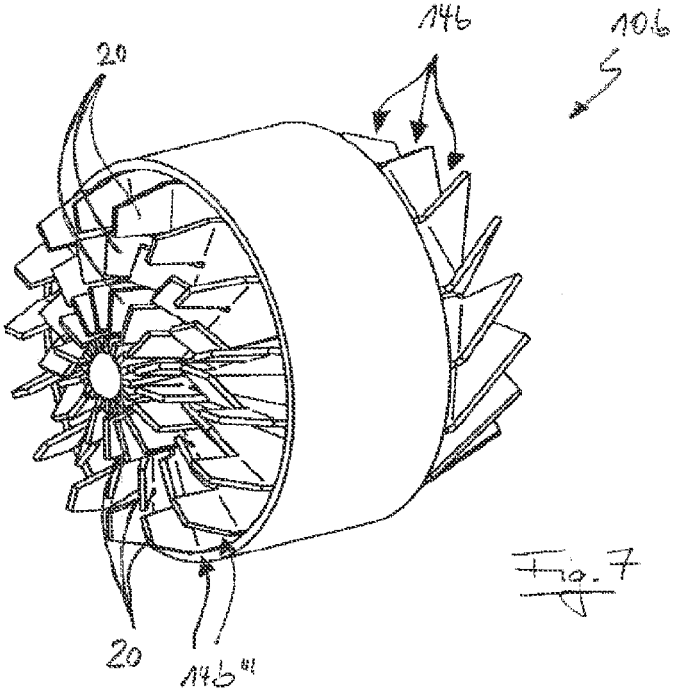
Figure 8:
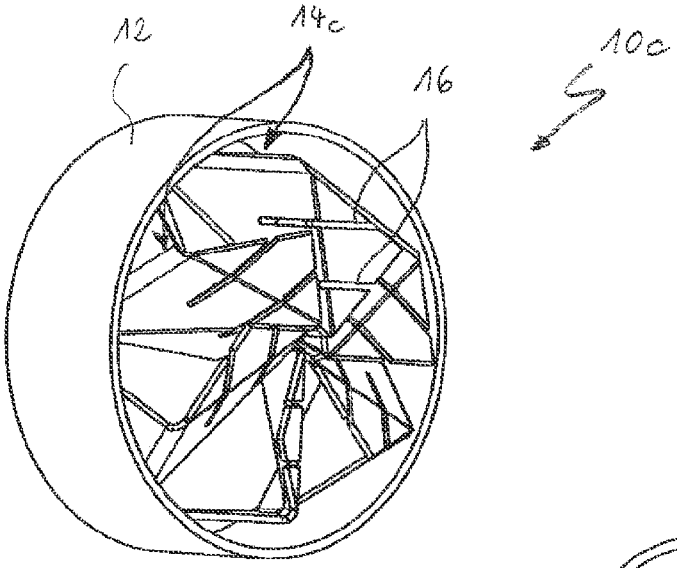
Figure 9:
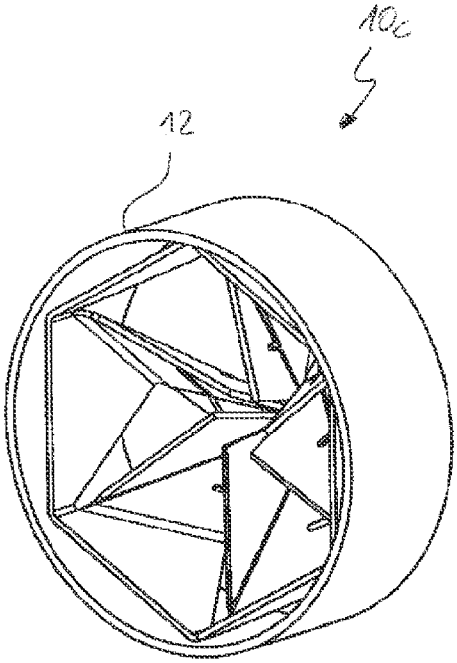
Figure 10:
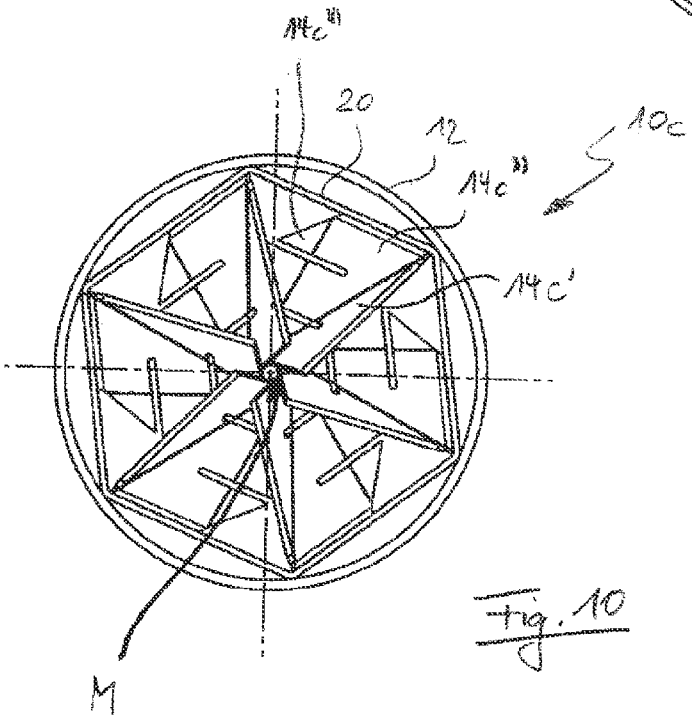
Figure 11:
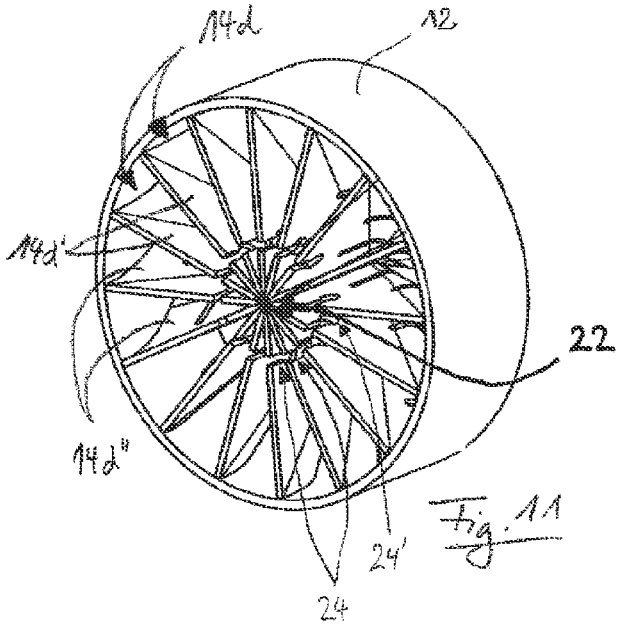
Figure 12:
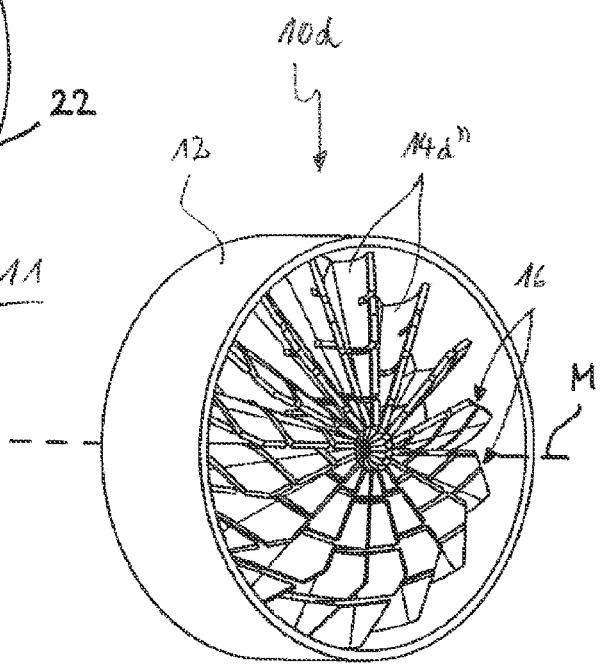
Figure 13:
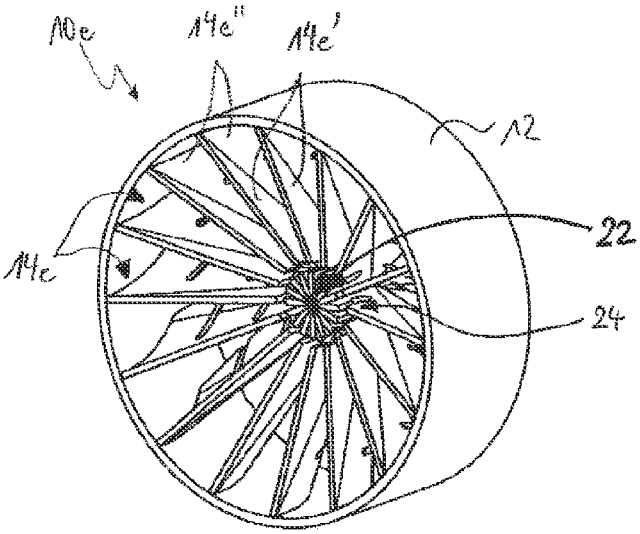
Figure 14:
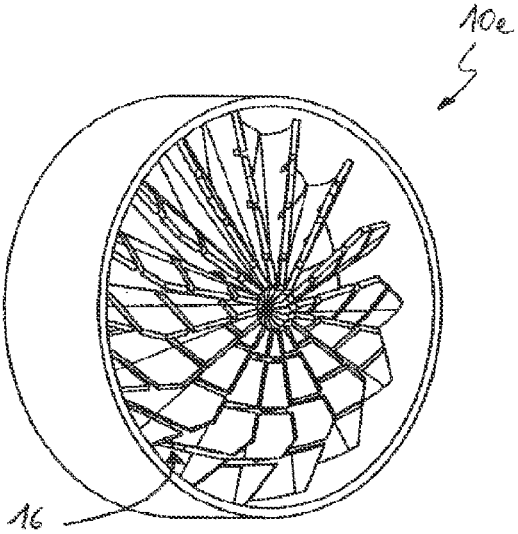
Figure 15:
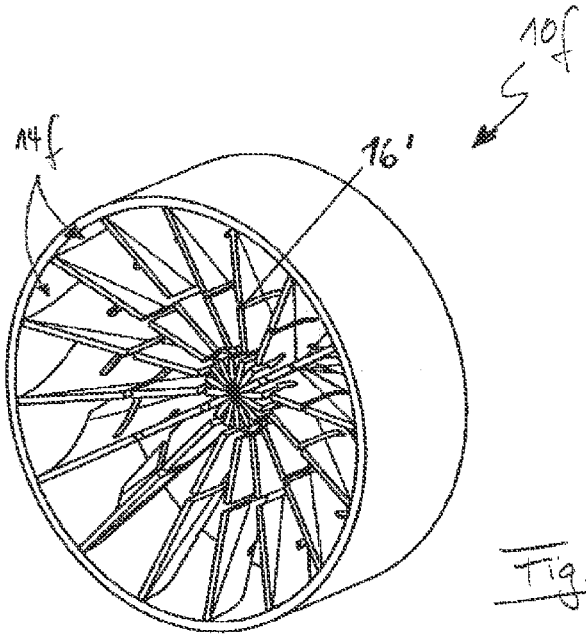
Figure 16:
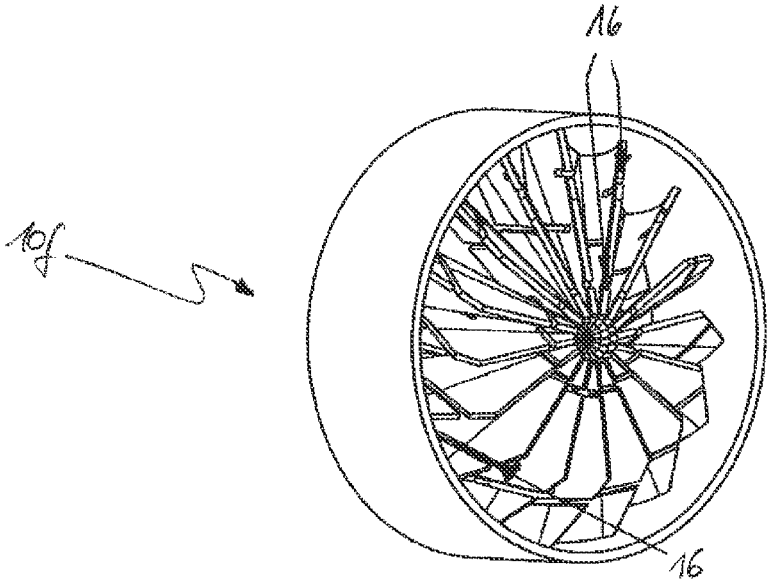

The present invention will be explained in the following purely by way of example with reference to advantageous embodiments and to the enclosed drawings. There are shown:

FIG. 1 a perspective view of a first embodiment of a mixer device in accordance with the invention in a view obliquely from the front—viewed in the flow direction of the gas flow;

FIGS. 2 to 4 the embodiment of FIG. 1 in a perspective view obliquely from behind, in a view from the front and in a view from the rear respectively;

FIG. 5 a mixer blade of the mixer device in accordance with FIG. 1 in a perspective view;

FIG. 6 the mixer blade of FIG. 5 in a side view;

FIG. 7 a perspective view of a second embodiment of a mixer device in accordance with the invention;

FIGS. 8 to 10 different perspective views of a third embodiment of a mixer device in accordance with the invention;

FIGS. 11 and 12 different perspective views of a fourth embodiment of a mixer device in accordance with the invention;

FIGS. 13 and 14 different perspective views of a fifth embodiment of a mixer device in accordance with the invention; and FIGS. 15 and 16 different perspective views of a sixth embodiment of a mixer device in accordance with the invention.

FIG. 1 shows a mixer device 10*a* which, for example, is used in an exhaust train of a motor vehicle to vaporize in the exhaust gas flow a urea solution introduced in the exhaust gas flow and to distribute it as homogenously as possible. The mixer device 10*a* comprises a ring-shaped housing 12 and a plurality of mixer blades 14*a* uniformly distributed about a center axis M in the peripheral direction. The mixer blades 14*a* have blade sections 14*a*', 14*a*" and 14*a*'" which are each essentially planar. The blade sections 14*a*', 14*a*" and 14*a*'" are inclined with respect to one another to defect a gas flow flowing onto the mixer device 10*a*, for example, essentially axially—i.e. parallel to the center axis M. The aim is thereby to obtain a gas flow which is as homogeneous as possible and in which suitable conditions are present for the chemical reactions required for efficient emission control. The blade sections 14*a*', 14*a*", 14*a*'" effect the following in detail:

First, the gas flow is defected by the blade sections 14*a*' so that a swirl is imparted to the flow. I.e. the blade sections 14*a*' have the effect that the gas flow receives a movement component in the peripheral direction. On the deflection of the gas flow, a number of the droplets contained in the gas flow—so-called primary droplets—impact the blade sections 14*a*' and at least partly vaporize there since the mixer blades 14*a* were heated by the hot exhaust gas flow. Some of the primary droplets burst on the blade sections 14*a*', whereby secondary droplets are formed which are again hurled into the exhaust gas flow. Some primary droplets are also reflected at the blade sections 14*a*'. It is understood that mixed forms of the above-described droplet-mixer blade interactions can also occur.

The mixer blades 14*a* can generally have a profile at their gas inlet side to achieve a deposition of the droplets on the inlet side of the mixer device 10*a*. In the present case, the mixer blades 14*a*, however, do not have any profile on the inlet side.

The blade sections 14*a*' are inclined both relative to the center axis M and relative to radial directions perpendicular thereto. In contrast to this, the blade sections 14*a*" only extend in the radial and axial directions. The blade sections 14*a*" effect a repeat deflection of the gas flow, whereby further collisions of the liquid droplets in the gas flow with the mixer blades 14*a* are provoked. The blade sections 14*a*'" adjoin the blade sections 14*a*" downstream and they are in turn inclined with respect to the blade sections 14*a*"—and also with respect to the blade sections 14*a*'. The gas flow thereby undergoes a swirl reversal, i.e. the swirl of the gas flow produced at the inlet side is reversed by the blade sections 14*a*'" since a new tangential component is imparted to the gas flow by its angled alignment.

The spatial arrangement and configuration of the blade sections 14*a*'" can in particular be clearly seen in FIG. 2. The blade sections 14*a*'" have slits 16 which effect a regulation of the temperature distribution by a local influencing of the thermal conductivity of the mixer blades 14*a* in order in particular to avoid the initially described disadvantageous effects in connection with a "film boiling". As a flanking measure or instead of the slits, materials can also be used in specific regions of the mixer blades which have a reduced thermal conductivity such as a ceramic material—for instance $ZrO_2$—or an increased thermal conductivity. In addition, the thickness of the mixer blades 14*a* can be reduced, for example to thicknesses below 1 mm. Direct thickened material portions can also be a suitable means for influencing the thermal conductivity. Additionally or alternatively, porous material can be used—for the mixer blade as a whole or also only locally—such as porous stainless steel sheets produced from structural paper or porous sheets produced from sintered wire mesh. Perforated stainless steel sheets—the perforations can be produced by means of laser perforation processes—or holed stainless steel sheets can likewise be configured in simple manner such that the desired temperature distribution is adopted at the surface of the mixer blades 14 in operation.

FIGS. 3 and 4 show a front view and a rear view respectively—with respect to the flow direction of the exhaust gas—of the mixer device 10*a* for illustrating its design.

FIG. 5 shows a mixer blade 14*a* in a perspective view. The dashed lines indicate the shape of a blank 18 which is shaped by suitable shaping processes to form the mixer blade 14*a*.

The blank 18 is a substantially planar sheet metal part which was cut to the desired external shape and was provided with slits 16. An outer edge 18*a* is connected to the housing 12 in the installation position of the mixer blade 14*a*, whereas an inner edge 18*b* is located in the region of the center axis M in the installation position. Starting from the blank 18, only two bending processes are required to produce the mixer blade 14*a*. For this purpose, the blade section 14*a*' is bent over along a bending edge B1 relative to the blade section 14*a*". The second bending process relates to the blade section 14*a*'" which is bent over along a second bend edge B2.

FIG. 6 illustrates the deflection of the exhaust gas flow by the mixer blade 14*a*. The exhaust gas flow is marked by arrows in this respect. It can be seen that the blade section 14*a*' first effects a deflection of the exhaust gas flow which imparts a tangential component with respect to the center axis M, which is directed upwardly in FIG. 6, to the exhaust gas flow. The blade section 14*a*'" in contrast has the effect that the exhaust gas flow has an essentially axial direction for a short path distance before a deflection of the exhaust gas flow caused by the blade section 14*a*'" again produces a tangential flow component which is opposite to the tangential component produced by the blade section 14*a*', but which is not necessarily of the same amount as it.

The side view of the mixer blade 14*a* also shows inclination angles N1, N2 of the blade sections 14*a*' and 14*a*'" respectively. The angle of inclination N1 is the inclination of the blade section 14*a*' in a tangential plane—the image plane of FIG. 6 which is arranged perpendicular to the radial extent of the mixer blade 14*a*—relative to the center axis M, whereas the angle of inclination N2 is the tangential component of the inclination of the blade section 14*a*'" relative to the center axis M.

In other words, the angle N1 is the angle which a gas particle entering into the mixer device 10*a* "sees" in the tangential direction. In order largely to avoid relevant flow separations, the angle of inclination N1 should amount to no more than 25°. In the case shown of a planar blade section 14*a*', the latter is inclined in the described manner at each point with respect to the arrow H which is shown upstream of the mixer blade 14*a* and which indicates a main flow direction flowing onto the mixer blade 14*a*. With a curved inlet-side blade section, what is important is that a corresponding angle of inclination N1 is present at least in the region of an inlet-side edge K1. I.e. a tangent at the surface of the blade section in the region of the edge K1 should include an angle of no more than 25° with the center axis M in a projection comparable with FIG. 6.

The same applies analogously to the angle of inclination N2 and to an outlet-side edge K2 of the blade section 14*a*'". The angle of inclination N2 should as a rule not exceed 35° in order to keep the counter pressure low which is caused by the mixer device. It is, however, understood that the angles N1, N2 can also be larger than 25° and 35° respectively in special cases.

As stated above, the angular positions of the blade sections 14*a*'. 14*a*'" with respect to the exhaust gas flow are comparatively small to avoid flow separations and dead water zones resulting therefrom and thus to minimize the counter-pressure produced by the mixer device 10*a*.

The configuration of the blade sections 14*a*', 14*a*". 14*a*'" can be adapted to the respective circumstances. The geometry and the position of the bending edges B1, B2 relative to the edges 18*a*, 18*b* can, for example, be varied to produce the desired flow profile. Further parameters which can be varied are, for example, the angles by which the blade sections 14*a*' and 14*a*'" respectively are bent over with respect to the blade section 14*a*". Deviating from the embodiment shown, the edges B1 and/or B2 can be replaced by curved regions. In particular when a transition region between the blade sections 14*a*" and 14*a*' is less abrupt and has a comparatively "gentle" or curved extent, flow separations can be avoided in this region.

The geometry of the mixer blade 14*a* has the consequence that an influencing of the gas flow caused by it is a function of the spacing from the center axis M. In the present case, the gas flow is deflected less in a region about the center axis M than in regions disposed radially further outwardly.

FIG. 7 shows a modification 10*b* of the mixer device 10*a*. The mixer device 10*b* has mixer blades 14*b* which are similar to the mixer blades 14*a* at the inlet side. Outlet-side blade sections 14*b*'" of the mixer blades 14*b* have, unlike the blade sections 14*a*' of the mixer blades 14*a*, segments 20 which are inclined alternatingly with respect to one another in order to achieve a greater turbulence of the gas flow at the outlet side and thus ultimately a better homogenization of the gas flow. The segments 20 produce different outlet angles of part flows of the gas flow as well as of the liquid droplets still possibly contained in the part flows. The different outlet angles effect an increased turbulence which contributes to an improved mixing of the exhaust gas flow in the wake of the mixer device 10*b*.

FIGS. 8 to 10 show an embodiment 10*c* of a mixer device whose mixer blades 14*c* are arranged in a frame 20 fastened in the housing 12. The mixer blades 14*c* are ordered—figuratively speaking—in a similar manner to petals in a uniform distribution about the center axis M. As can be seen from FIG. 8, which shows a perspective view of the mixer device 10*c* obliquely from behind, the mixer blades 14*c* are provided at their outlet-side end with slits 16 which are provided for influencing the thermal conduction. The mixer blades 14*c* have blade sections 14*c*', 14*c*" and 14*c*'"—see FIG. 10—which have different angles of inclination relative to the gas flow flowing onto the mixer device 10*c*. However, they do not effect any swirl reversal, but the swirl produced by the inlet-side blade sections 14*c*' is rather successively amplified by the blade sections 14*c*", 14*c*". This multistage swirl production is accompanied by a comparatively small counter-pressure production and nevertheless delivers good mixing results and vaporization results since this construction also has an improved droplet-mixer blade interaction in comparison with conventional mixer devices.

FIG. 11 shows a mixer device 10*d* having mixer blades 14*d* which each comprise a substantially planar blade section 14*d*' which does not have any significant inclination with respect to the onflowing gas and a curved blade section 14*d*'". The mixer blades 14*d* are provided with slits 16 open downstream such as can in particular also be seen from FIG. 12. The length of the slits decreases from the center axis M toward the housing 12.

The mixer blades 14*d* are in close contact in the region about the center axis M. However, they are not welded or soldered together in as comprehensive a manner as possible, but are rather only held together by an auxiliary assembly weld site 22. On the assembly of the mixer device 10*d*, the mixer blades 14*d* are first fixed relative to one another by the weld site 22. The weld site 22 is a simple weld point which connects the mixer blades 14*d* at the inlet side in a point-like manner and localized in the region of the center axis M. The mixer blades 14*d* are not connected to one another apart from the weld site 22. Thermomechanical stresses can thereby be at least partly eliminated. The localized weld site 22 does not prevent the outlet ends of the mixer blades 14*d* from carrying out relative movements also in the region of the center axis M. These movements compensate the temperature expansion of the mixer blades 14*d*, which ultimately prevents their connections to the housing 12 from being put under excessive stress.

Joins 24 are provided—as can in particular be seen in FIG. 11—which are open at the inlet side and which end in a hole-like end section 24' to improve the mechanical decoupling of the mixer blades 14*d*. The joins 24 are arranged comparatively close to the center axis M and allow a large decoupling—with respect to thermomechanical stresses—of the weld site 22 from the outer connection of the mixer blades 14*d* due to the spatial proximity of the joins to the weld site 22.

FIGS. 13 and 14 show a mixer device 10*e* whose mixer blades 14*e* have a somewhat different geometry, in particular with respect to the planar blade sections 14*e*' and the curved blade sections 14*e*", than the mixer blades 14*d* of the mixer device 10*d*. As with the mixer device 10*d*, the mixer blades 14*e* of the mixer device 10*e* are only connected to one another in the region of the center axis M by an auxiliary assembly weld site 22. To increase the movability of the mixer blades 14*e* relative to one another and thus to be able better to eliminate thermomechanical stresses, the mixer blades 14*e* are likewise each provided with joins 24 which are, however, disposed closer to the center axis M in comparison with the joins 24 of the mixer device 10*d*. It is understood that the position and the configuration of the joins 24 can be adapted so that thermomechanical stresses are admittedly compensated as best as possible, but without the stability of the respective mixer device being simultaneously compromised.

FIGS. 15 and 16 show a mixer device 10*f* which is similar to the mixer device 10*e* in a number of aspects. However, the mixer blades 14*f* of the mixer device 10*f* are provided with slits 16, 16' which are alternatingly open at the inlet side or at the outlet side so that a suitable temperature distribution is formed in their operation, in particular at the surface of the mixer blades 14*f*, to avoid the initially discussed problems.

The concept of the auxiliary assembly weld point 22 and of the joins 24 was admittedly only described in connection with the mixer devices 10*d*, 10*e*; however, this concept can also easily be transferred to the mixer devices 10*a*, 10, 10*c*, 10*f*.

REFERENCE NUMERAL LIST

10*a*, 10*b*, 10*c*, 10*d*, 10*e*, 10*f* mixer device
12 housing
14*a*, 14*b*, 14*c*, 14*d*, 14*e*, 14*f* mixer blade
10*a*', 10*a*", 14*a*'", 14*b*", 14*c*',

14*c*", 14*d*', 14*d*", 14*e*', 14*e*" blade section
16, 16' slit
18 blank
18*a* outer edge
18*b* inner edge
20 frame
22 auxiliary assembly weld site
24'" join
24 end section
M center axis
B1, B2 bending edge
N1, N2 angle of inclination
H main flow direction
K1 inlet-side edge
K2 outlet-side edge

The invention claimed is:

1. A mixer device for distributing and vaporizing a liquid introduced into one of a gas flow and an exhaust gas flow, wherein the mixer device comprises at least one mixer blade (14*a* 14*b*) which influences the flow direction of the gas flow and which has a first blade section (14*a*') and a second blade section (14*a*'", 14*b*'"), said first blade section and said second blade section being arranged behind one another in the flow direction of the gas flow and being configured such that the first blade section (14*a*') deflects the gas flow flowing onto the mixer device such that said gas flow receives a first swirl component and such that the second blade section (14*a*'", 14*b*'") subsequently deflects the gas flow such that it receives a second swirl component, wherein the first swirl component and the second swirl component are opposite to one another, further comprising a third blade section arranged in the axial direction between the first blade section and the second blade section and wherein said third blade section is configured as one of a plane that extends in substantially the axial direction of the mixer device.

2. The mixer device in accordance with claim 1, wherein the first swirl component and the second swirl component are of different amounts.

3. The mixer device in accordance with claim 1, wherein at least one of the first blade section (14*a*') and the second blade section (14*a*'", 14*b*'") are inclined or curved with respect to a center axis (M) of the mixer device and wherein optionally at least one of the first blade section (14*a*') and the second blade section (14*a*'", 14*b*'") have different angles of inclination or curvatures with respect to the center axis (M).

4. The mixer device in accordance with claim 1, wherein at least one of the first blade section (14*a*') and the second blade section (14*a*'", 14*b*'") forms a plane.

5. The mixer device in accordance with claim 1, wherein at least one of an angle of inclination (N1) of the first blade section (14*a*') amounts to no more than 25° at least at its upstream end with respect to the center axis and an angle of inclination (N2) of the second blade section (14*a*'", 14*b*'") amounts to no more than 35° at least at its downstream end with respect to the center axis (M).

6. The mixer device in accordance with claim 1, wherein at least one of the first blade section and the second blade section (14*b*'") comprises at least two segments (19) which have different angles of inclination or curvatures with respect to the center axis (M).

7. The mixer device in accordance with claim 1, wherein a transition region between one of the first blade section (14*a*') and the second blade section (14*a*'"), the first blade section (14*a*') and the third blade section (14*a*"), and the third blade section (14*a*') and the second blade section (14*a*'") is a straight edge (B1 or B2) inclined with respect to a center axis (M) of the mixer device.

8. The mixer device in accordance with claim 1, wherein the mixer blade (14*a*, 14*b*, 14*c*, 14*d*, 14*e*, 14*f*) extends from a center axis (M) of the mixer device in a substantially radial direction toward one of a housing (12) and a ring shaped housing.

9. The mixer device in accordance with claim 1, wherein a plurality of mixer blades (14*a*, 14*b*, 14*c*, 14*d*, 14*e*, 14*f*) are provided which are arranged one of distributed and uniformly distributed in the peripheral direction of the mixer device.

* * * * *